US007367572B2

(12) United States Patent
Jiang

(10) Patent No.: US 7,367,572 B2
(45) Date of Patent: May 6, 2008

(54) SKATEBOARD

(76) Inventor: Xiancan Jiang, Guangzhou Peerless Corp., Longkou Industrial, Guangzhou (CN) 510880

( * ) Notice: Subject to any disclaimer, the term of this patent is extended or adjusted under 35 U.S.C. 154(b) by 239 days.

(21) Appl. No.: 11/132,599

(22) Filed: May 19, 2005

(65) Prior Publication Data

US 2006/0055137 A1 Mar. 16, 2006

(30) Foreign Application Priority Data

Sep. 13, 2004 (CN) ..... 2004 2 0083896 U

(51) Int. Cl.
*B62M 7/00* (2006.01)

(52) U.S. Cl. ..... 280/87.042; 280/87.041; 280/87.021

(58) Field of Classification Search ..... 280/87.021, 280/87.041, 87.042, 400
See application file for complete search history.

(56) References Cited

U.S. PATENT DOCUMENTS 4,076,267 A * 2/1978 Lipscomb ..... 280/87.042
4,082,306 A * 4/1978 Sheldon ..... 280/87.042
4,955,626 A * 9/1990 Smith et al. ..... 280/87.042
5,458,351 A * 10/1995 Yu ..... 280/87.042
5,505,474 A * 4/1996 Yeh ..... 280/87.042
5,540,455 A * 7/1996 Chambers ..... 280/87.042
6,270,091 B1 * 8/2001 Smith ..... 280/14.21
6,338,494 B1 * 1/2002 Killian ..... 280/87.042
7,083,178 B2 * 8/2006 Potter ..... 280/87.042
2004/0262872 A1 * 12/2004 Kang ..... 280/87.042
2005/0012290 A1 * 1/2005 McClain ..... 280/87.042

* cited by examiner

*Primary Examiner*—Christopher P. Ellis
*Assistant Examiner*—Katy Meyer
(74) *Attorney, Agent, or Firm*—Hamre, Schumann, Mueller & Larson, P.C.

(57) ABSTRACT

A skateboard in accordance includes a footplate (1) having a lower surface, a front wheel and a rear wheel (3) arranged in a front end and a rear end of the lower surface respectively, wherein the wheels are universal, and the footplate includes a front plate (17) and a rear plate (18). The front plate and the rear plate are connected via a rotatable torsional mechanism, and a restriction element (4) is defined between each plate and the torsional mechanism for restricting the rotation range of the torsional mechanism.

12 Claims, 2 Drawing Sheets

SKATEBOARD

BACKGROUND OF THE INVENTION

1. Field of the Invention

The present invention relates to a skateboard, and particularly to a sporting skateboard.

2. Description of the Prior Art

As a sport, skateboarding is popular all around the world, especially in the youth.

The conventional skateboard typically comprises a board body comprising a front end and a rear end. Each end defines a wheel or a serial of wheels, and a brake is provided at the front end of the board body. In use, the skater usually seats his one foot on a top surface of the board body, and then steps against the ground with another foot. When the skateboard moves fast enough, the skater puts his two feet on the top surface of the board body, and moves together with the skateboard because of the inertia thereof.

Obviously, the friction between the wheels and the ground will hold back the movement of the skateboard. When the skateboard is prone to stop, the skater has to step against the ground again, therefore pushing the skateboard to move continually. It is inconvenient for the skater to drive the skateboard. Furthermore, when the skater needs to turn the ski board around, the friction becomes much larger. Therefore, the skateboard will stop in a short time.

Furthermore, the conventional skateboard is integrated molded, and the integrated board body is not flexible. When the skater seats on the skateboard, it is very difficult to adjust his center of gravity to balance himself, especially in fast moving. Thus, the skater will probably fall down from the skateboard.

In view of the above, a new skateboard which overcomes the above-mentioned disadvantages is desired.

SUMMARY OF THE INVENTION

Accordingly, what is need of the present invention is to provide a skateboard that moves hardly depending on the inertia thereof, and the skateboard has better operation performance and safety performance.

To achieve the above-mentioned object, a skateboard in accordance with a preferred embodiment of the present invention comprises a footplate having a lower surface, a front wheel and a rear wheel arranged in a front end and a rear end of the lower surface respectively, wherein the wheels are universal, and the footplate comprises a front plate and a rear plate. The front plate and the rear plate are connected via a torsional mechanism, and a restriction element is defined between each plate and the torsional mechanism for restricting distortion range of the torsional mechanism.

Because the footplate is divided into front plate and rear plate, and the torsional mechanism is flexible, and also because of the restrictive function of the restrictive element and the perfect turning performance of universal wheel, the front plate and the rear plate are rotatable to each other in moving. Therefore, it is easier for the skater to balance himself, and safety performance of the skateboard is achieved.

In use, the skater seats two feet on the top surface of the front plate and the rear plate respectively, and applies a certain force on each plate by adjusting his center of gravity. Because the rotation performance of the torsional mechanism, together with the universal wheels, said force will be transferred to a promotion to drive the skateboard move forward substantially along an S-shaped trail. Therefore, the skateboard moves hardly depending on inertia thereof, and the operation is simplified.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
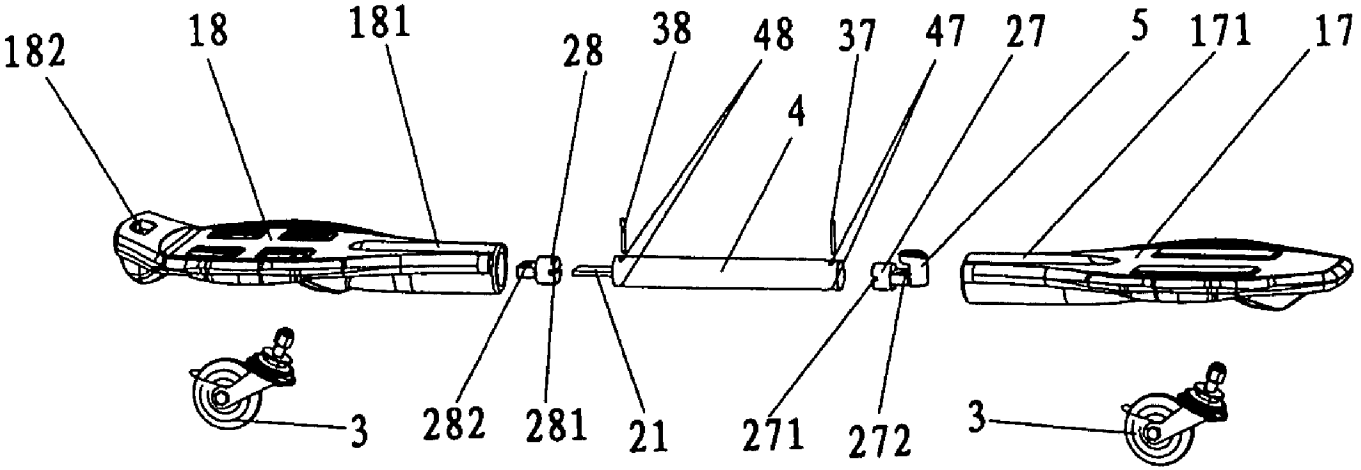
FIG. 1 is an exploded, isometric view of a skateboard in accordance with a preferred embodiment of the present invention.

Referring to FIG. 1, a skateboard in accordance with the preferred embodiment of the present invention comprises a footplate 1 (referring to FIG. 3) and two wheels. The footplate 1 comprises a front plate 17 and a rear plate 18, and the front plate 17 and rear plate 18 are connected via a flexible torsional mechanism. The wheels are universal, and they are attached on a lower surface of the front plate 17 and the rear plate 18, respectively. The universal wheels each defines an inclined supporting portion, and an acute angle is formed between the front/rear plate and the supporting portion of the wheel. In the preferred embodiment of the invention, the acute angle is 60 degrees. Because of the acute angle between the front/rear plate and corresponding wheel, an accordant moving direction between the wheels at two ends is ensured.

Figure 2:
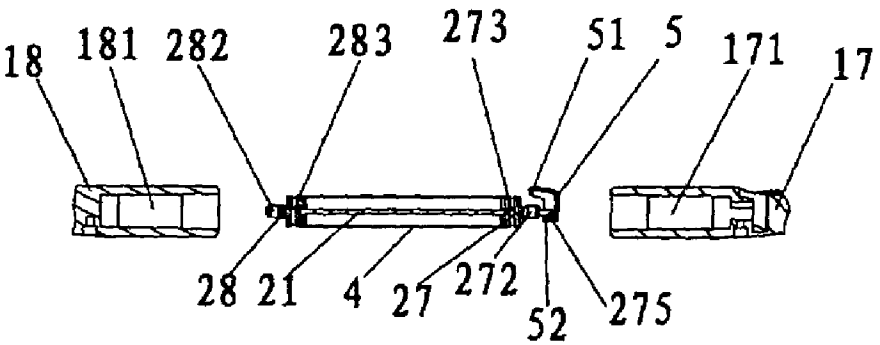
FIG. 2 is a partly cross-sectional plan view of the exploded skateboard in accordance with the preferred embodiment of the invention.

Referring to FIGS. 1 and 2, the torsional mechanism is defined in middle of the front plate 17 and the rear plate 18 along elongate direction. The torsional mechanism comprises an elastic element 21, a front connection portion 27 and a rear connection portion 28. One end of each connection portion 27, 28 defines a slot 271, 281 for receiving and securing corresponding end of the elastic element 21 respectively, therefore the elastic element 21 is restricted between the connection portions 27, 28. A screw hole 272, 282 is defined in another end of each connection portion 27, 28. Therefore, the front connection portion 27 and rear connection 28 can connected with the front plate 17 and rear plate 18 by extending a screw pole (not shown) through corresponding screw hole 272, 282 respectively. Furthermore, the front connection portion 27 and rear connection portion 28 each defines a through hole 273, 283, and a bolt 37, 38 extends through corresponding through hole 273, 283.

Referring also to FIGS. 1 and 2, the restriction element is an elongate sleeve 4. The sleeve 4 is defined between the footplate 1 and the torsional mechanism, and the sleeve 4 receives the torsional mechanism therein. Each end of the sleeve 4 defines two holes 47, 48 in opposite positions of the circle of the sleeve, and the holes 47, 48 are corresponding to the through hole 273, 283 of the front connection portion 27 and rear connection portion 28 respectively. Therefore, the front connection portion 27 and rear connection portion 28 are attached on the sleeve 4 by extending the bolts 37, 38 through the holes 47, 48 and through holes 273, 283.

For appearance of the skateboard, the front plate 17 and the rear plate 18 each defines a cavity 171, 181 for receiving the torsional mechanism and restriction element.

Figure 3:
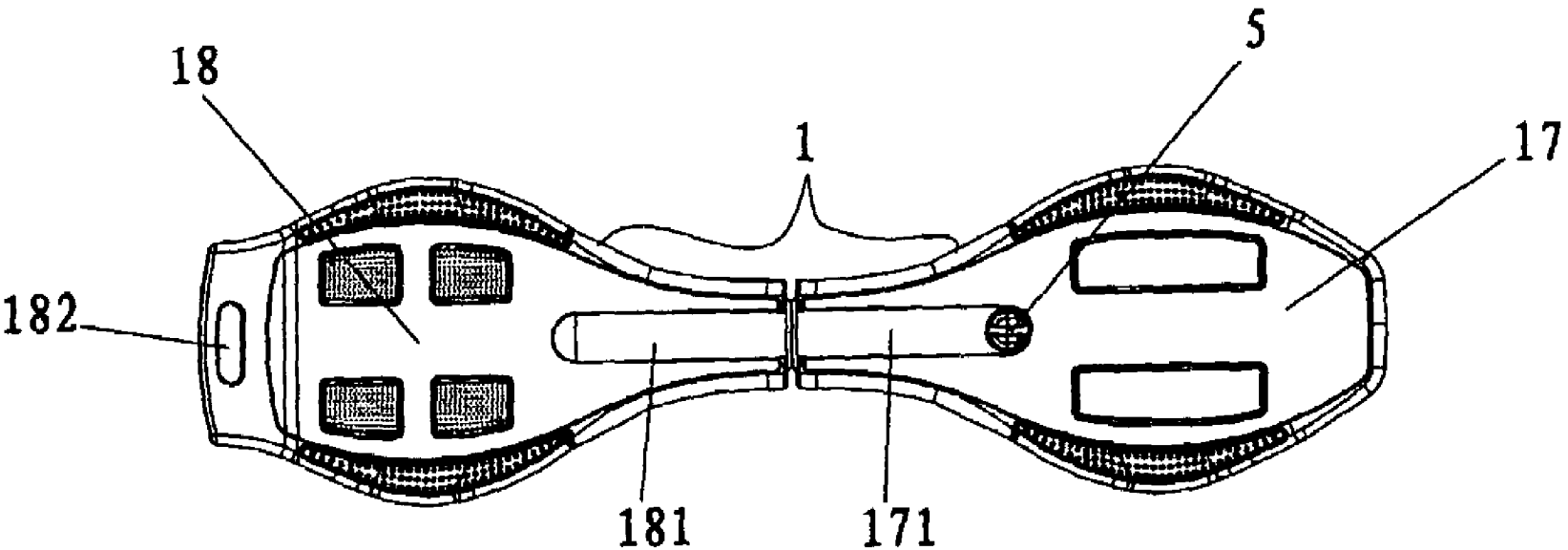
FIG. 3 is a top plan view of the assembled skateboard in accordance with the preferred embodiment of the present invention.

Referring to FIGS. 2 and 3, the front connection portion 27 defines a extending portion 275, and a cap 5 is mounted on the extending portion 275. The cap 5 is clasped between the footplate 1 and the extending portion 275. The cap 5 comprises a top surface 51 and a lower surface 52. When the torsional mechanism is mounted in the sleeve 4, the extending portion 275, together with the top surface 51 and the lower surface 52, prevents the cap 5 from falling away. In another end of the rear plate 18, a binding hole 182 (referring to FIGS. 1 and 3) is arranged, therefore, a string (not shown) can be used to bind one end on the cap 5 and another end on the binding hole 182 for hanging the skateboard or being conveniently taking out by the skater.

As conventional skateboard, the preferred embodiment of the invention also defines a brake (not shown) in front end of the lower surface of the front plate 17.

The torsional mechanism is defined in a middle position along the longitudinal direction of the elongate front plate 17 and rear plate 18, and a little departure from the middle position will not affect the performance of the skateboard much.

The elastic element 21 may be one piece or multi pieces, and it may be made of metal or some other elastic materials, such as rubber.

In assembly, firstly, the elastic element 21 is mounted between the front connection portion 27 and the rear connection portion 28 to form the torsional mechanism. The torsional mechanism then extends through the sleeve 4. Secondly, the bolts 37, 38 extend through corresponding holes 47, 48 of the sleeve 4 and through holes 273, 283 of the connection portions 27, 28, therefore the sleeve 4 and the torsional mechanism are mounted together. Lastly, the sleeve 4 and the torsional mechanism are inserted into the cavities 171, 181 of the front plate 17 and the rear plate 18, and are attached in the front plate 17 and rear plate 18.

In use, the skater seats his one foot on the front plate 17, and steps his another foot against the ground. The skateboard will move forward, and then the skater puts his two feet on the skateboard. Because of the rotation performance of the torsional mechanism, the skater can easily adjust his center of gravity to balance himself. When the skater applies a certain force on the front plate and the rear plate, the torsional mechanism, together with the universal wheels, will transfer said force to a promotion to drive the skateboard move forward, along substantially an S-shaped trial.

To achieve predetermined performance, the essential features of the preferred embodiment of the invention comprise a separated footplate, a rotatable torsional mechanism, a restriction element and universal wheels. In the preferred embodiment, the structure of the skateboard is simplified, and it has better agility. Therefore, it is easier for the skater to adjust his center of gravity. When the skater stands on the fast moving skateboard, it is easy for him to adjust his center of gravity and simultaneously apply a certain force to push the skateboard to move continually or turn around. The moving of the skateboard hardly depends on inertia thereof, and the skateboard is safer for preventing the skater from falling down from it.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. A skateboard, comprising:

a footplate comprising a lower surface, the lower surface comprising a front end and a rear end;

wheels attached at the front end and rear end of the lower surface;

wherein the wheels are universal, the footplate comprising a front plate, a rear plate, and a rotatable torsional mechanism connecting the front plate and the rear plate, and a restriction element enclosing the torsional mechanism for restricting rotation range of the torsional mechanism, wherein the torsional mechanism comprises a front connection portion, a rear connection portion and at least an elastic element attached between the front connection portion and the rear connection portion, and the elastic element connects with the front plate and the rear plate via the front connection portion and the rear connection portion respectively, wherein the elastic element is plate configuration, and the front connection portion and the rear connection portion each defines a slot in one end thereof, and the elastic element is attached between the front connection portion and the rear connection portion, wherein the other end of each of the front connection portion and the rear connection portion defines a screw hole, and the front connection portion and the rear connection portion are attached on the front plate and the rear plate by extending a screw pole through corresponding screw hole, and wherein the front connection portion comprises an extending portion, and a cap is clasped between the extending portion and the front plate, and the cap comprises a top surface and a lower surface, and the extending portion, together with the top surface and the lower surface, prevents the cap from falling away, and the rear plate further comprises a binding hole.

2. A skateboard, comprising:

a footplate comprising a lower surface, the lower surface comprising a front end and a rear end;

wheels attached at the front end and rear end of the lower surface;

wherein the wheels are universal, the footplate comprising a front plate, a rear plate, and a rotatable torsional mechanism connecting the front plate and the rear plate, and a restriction element enclosing the torsional mechanism for restricting rotation range of the torsional mechanism, wherein the torsional mechanism comprises a front connection portion, a rear connection portion and at least an elastic element attached between the front connection portion and the rear connection portion, and the elastic element connects with the front plate and the rear plate via the front connection portion and the rear connection portion respectively, wherein the elastic element is plate configuration, and the front connection portion and the rear connection portion each defines a slot in one end thereof, and the elastic element is attached between the front connection portion and the rear connection portion, wherein the other end of each of the front connection portion and the rear connection portion defines a screw hole, and the front connection portion and the rear connection portion are attached on the front plate and the rear plate by extending a screw pole through corresponding screw hole, and wherein the restriction element is a sleeve, and the elastic element is received in the sleeve, and the front connection portion and the rear connection portion each comprises a through hole, and each end of the sleeve defines holes corresponding to the through holes, and bolts are defined for extending through said holes and through boles.

3. The skateboard as claimed in claim 2, wherein the front plate and the rear plate each defines a cavity for receiving the torsional mechanism and the restriction element.

4. The skateboard as claimed in claim 2, wherein each end of the sleeve comprises two holes opposite to each other in a circle of the sleeve.

5. The skateboard as claimed in claim 2, wherein the universal wheel comprises a supporting portion, and an acute angle is formed between the supporting portion and the footplate.

6. The skateboard as claimed in claim 5, wherein the acute angle is 60 degrees.

7. A skateboard comprising:

a footplate comprising a lower surface, the lower surface comprising a front end and a rear end;

wheels attached at the front end and rear end of the lower surface;

wherein the wheels are universal, the footplate comprising a front plate, a rear plate, and a rotatable torsional mechanism connecting the front plate and the rear plate, and a restriction element being defined between the torsional mechanism and the footplate for restricting rotation range of the torsional mechanism, wherein the torsional mechanism comprises a front connection portion, a rear connection portion and at least an elastic element attached between the front connection portion and the rear connection portion, and the elastic element connects with the front plate and the rear plate via the front connection portion and the rear connection portion respectively, wherein the elastic element is plate configuration, and the front connection portion and the rear connection portion each defines a slot in one end thereof, and the elastic element is attached between the front connection portion and the rear connection portion, wherein the other end of each of the front connection portion and the rear connection portion defines a screw hole, and the front connection portion and the rear connection portion are attached on the front plate and the rear plate by extending a screw pole through corresponding screw hole, and wherein the front connection portion comprises an extending portion, and a cap is clasped between the extending portion and the front plate, and the cap comprises a top surface and a lower surface, and the extending portion, together with the top surface and the lower surface, prevents the cap from falling away, and the rear plate further comprises a binding hole.

8. A skateboard comprising:

a footplate comprising a lower surface, the lower surface comprising a front end and a rear end;

wheels attached at the front end and rear end of the lower surface;

wherein the wheels are universal, the footplate comprising a front plate, a rear plate, and a rotatable torsional mechanism connecting the front plate and the rear plate, and a restriction element being defined between the torsional mechanism and the footplate for restricting rotation range of the torsional mechanism, wherein the torsional mechanism comprises a front connection portion, a rear connection portion and at least an elastic element attached between the front connection portion and the rear connection portion, and the elastic element connects with the front plate and the rear plate via the front connection portion and the rear connection portion respectively, wherein the elastic element is plate configuration, and the front connection portion and the rear connection portion each defines a slot in one end thereof, and the elastic element is attached between the front connection portion and the rear connection portion, wherein the other end of each of the front connection portion and the rear connection portion defines a screw hole, and the front connection portion and the rear connection portion are attached on the front plate and the rear plate by extending a screw pole through corresponding screw hole, and wherein the restriction element is a sleeve, and the elastic element is received in the sleeve, and the front connection portion and the rear connection portion each comprises a through hole, and each end of the sleeve defines holes corresponding to the through holes, and bolts are defined for extending through said holes and through holes.

9. The skateboard as claimed in claim 8, wherein the front plate and the rear plate each defines a cavity for receiving the torsional mechanism and the restriction element.

10. The skateboard as claimed in claim 8, wherein each end of the sleeve comprises two holes opposite to each other in a circle of the sleeve.

11. The skateboard as claimed in claim 8, wherein the universal wheel comprises a supporting portion, and an acute angle is formed between the supporting portion and the footplate.

12. The skateboard as claimed in claim 11, wherein the acute angle is 60 degrees.

* * * * *